US006629737B2

(12) United States Patent
Wiggins

(10) Patent No.: US 6,629,737 B2
(45) Date of Patent: Oct. 7, 2003

(54) CONTAINMENT SYSTEM FOR BATTERIES OF AN EQUIPMENT ENCLOSURE

(75) Inventor: William Byron Wiggins, Marietta, GA (US)

(73) Assignee: Marconi Communications, Inc., Cleveland, OH (US)

( * ) Notice: Subject to any disclaimer, the term of this patent is extended or adjusted under 35 U.S.C. 154(b) by 92 days.

(21) Appl. No.: 09/782,831

(22) Filed: Feb. 14, 2001

(65) Prior Publication Data

US 2002/0109440 A1 Aug. 15, 2002

(51) Int. Cl.[7] ..... A47B 97/00
(52) U.S. Cl. ..... 312/223.1; 180/68.5
(58) Field of Search ..... 312/223.1, 223.2, 312/257.1, 265.1; 180/68.5; 248/500, 503; 429/96, 99

(56) References Cited

U.S. PATENT DOCUMENTS 2,709,494 A * 5/1955 Luce ..... 180/68.5
3,623,917 A * 11/1971 Chassoux ..... 429/99
4,252,206 A * 2/1981 Burkholder et al. ..... 180/68.5
4,317,497 A * 3/1982 Alt et al. ..... 180/68.5
4,723,618 A * 2/1988 Coonradt ..... 180/68.5
5,198,638 A * 3/1993 Massacesi ..... 219/209
5,806,948 A * 9/1998 Rowan, Sr. et al. .. 312/223.1 X
6,154,361 A * 11/2000 Anderson et al. .... 312/223.1 X
6,164,369 A * 12/2000 Stoller ..... 165/104.33
6,347,678 B1 * 2/2002 Osborn et al. ..... 180/68.5

FOREIGN PATENT DOCUMENTS

FR 1354308 * 1/1964 ..... 312/223.1

* cited by examiner

*Primary Examiner*—James O. Hansen
(74) *Attorney, Agent, or Firm*—Jones Day

(57) ABSTRACT

A containment system for batteries of a data transmission equipment enclosure is disclosed. The system includes a number of identical side plates and integral top flanges for positioning around the batteries along with a front retention bar that has a series of slots for mating with slots formed in the side plates. A top channel frame member is connected to each of the side plates and to the enclosure. The system when installed in an enclosure prevents sideward, frontward and damaging upward movements of the batteries in response to seismic events. The system is careful, however, not to block the region under the batteries so that a heating pad can easily be installed if desired.

14 Claims, 6 Drawing Sheets

CONTAINMENT SYSTEM FOR BATTERIES OF AN EQUIPMENT ENCLOSURE

BACKGROUND OF THE INVENTION

1. Field of the Invention

The present invention relates to a containment system and more particularly to a simple, reliable and inexpensive system for restraining batteries in an equipment enclosure to protect the batteries during seismic events.

2. Description of the Related Art

Equipment enclosures for telecommunications, cable television and other data transmission equipment are in use around the country, often as outdoor stand-alone units. Each enclosure generally has an upper compartment or chamber for electronic components, a lower compartment for back-up batteries to provide power should commercial power fail, and side compartments for other equipment. In some areas of the country the enclosures are subjected to seismic events, such as earthquakes. Hence, it is desirable to restrain the batteries in some fashion. Previous systems included brackets and straps, typically constraining the batteries from their bottom surfaces or their bottom portions. When this is done, it is difficult to place a heating pad or heating plate beneath the batteries because of the restraining equipment. Heating batteries may be desirable since certain types of batteries operate most efficiently and with longer life at specific temperatures, often above ambient. Hence, depending upon ambient weather conditions, heating the batteries may be justified.

BRIEF SUMMARY OF THE INVENTION

The difficulties encountered by previous devices have been overcome by the present invention. What is described here is a containment system for a battery compartment of an equipment enclosure comprising a plurality of side plates, each side plate adapted to be placed along side a battery, a plurality of top flanges, each top flange being connected to a corresponding side plate, a front retainer bar adapted to engage each of the plurality of side plates for preventing forward movement of the batteries, and an extended top frame member connected to each side plate for connecting each of the side plates together and to the enclosure.

There are a number of advantages, features and objects achieved with the present invention which are believed not to be available in earlier related devices. For example, one advantage is that the present invention is an enclosure containment system which is simple, reliable and inexpensive. Another feature of the present invention is to provide a containment system for batteries of an equipment enclosure so as to protect the batteries against seismic events. Still another object of the present invention is to provide a containment system for restraining batteries of an equipment enclosure against seismic events without blocking the space under the batteries within the enclosure. Yet another feature of the present invention is to provide a containment system for a battery compartment of an equipment enclosure without using any loose hardware or straps. A further advantage of the present invention is to provide a battery containment system for an equipment enclosure which is modular and thereby able to fit in a number of different size enclosures and constrain the battery or batteries regardless of their number.

A more complete understanding of the present invention and other objects, advantages and features thereof will be gained from a consideration of the following description of the preferred embodiments read in conjunction with the accompanying drawing provided herein.

DETAILED DESCRIPTION OF THE INVENTION

Figure 1:
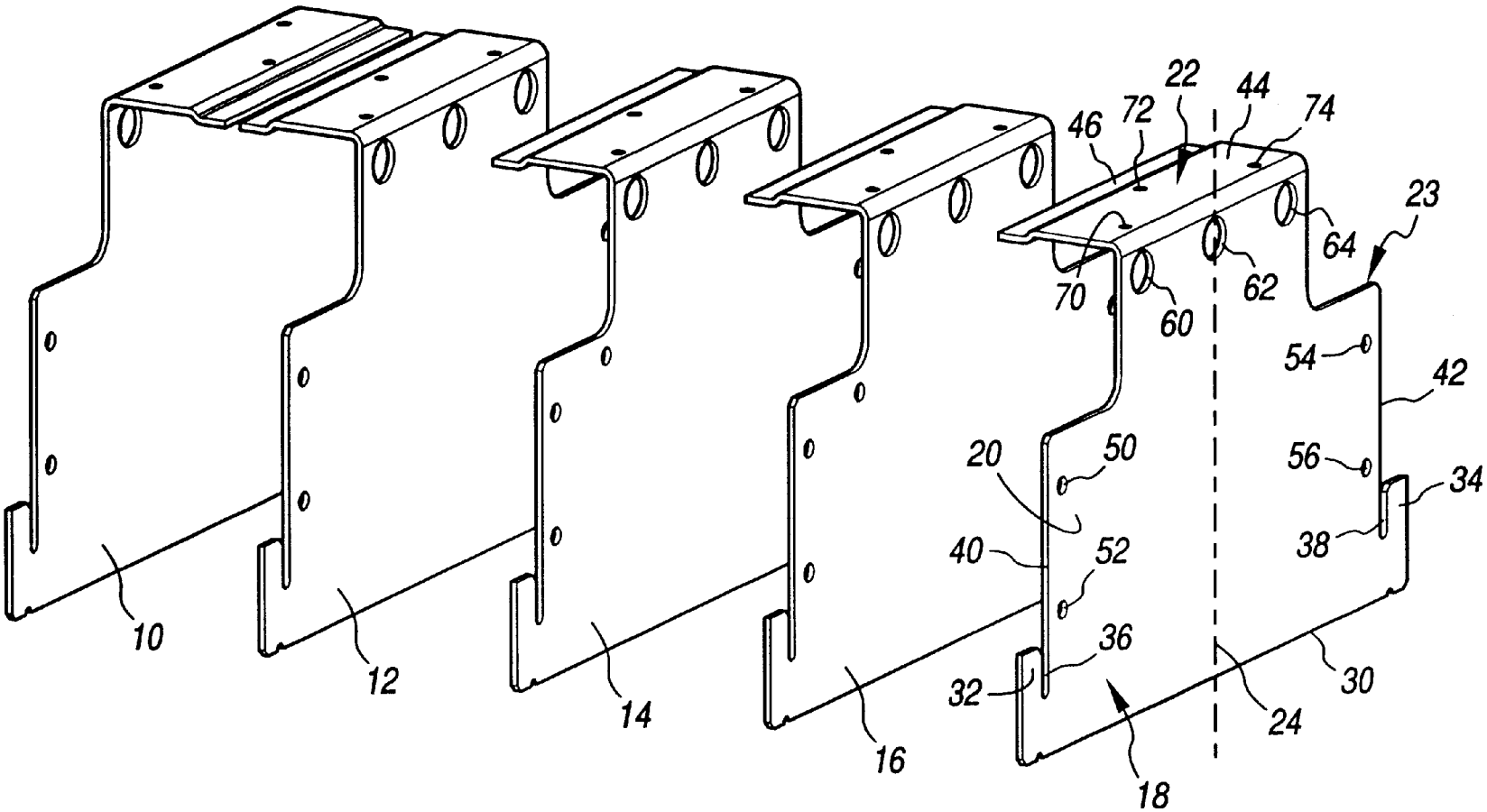
FIG. 1 is a downward looking isometric view of five aligned side plates of the present invention.

While the present invention is open to various modifications and alternative constructions, the preferred embodiments shown in the drawing will be described herein in detail. It is understood, however, that there is no intention to limit the invention to the particular forms disclosed. On the contrary the intention is to cover all modifications, equivalent structures and methods, and alternative constructions falling within the spirit and scope of the invention as expressed in the appended claims.

The simplicity, reliability and inexpensiveness of the present invention may best be exemplified by referring to FIG. 1 where there is shown a portion of the containment system in the form of five side plates, 10, 12, 14, 16 and 18. As can be seen, each of the plates is identical to each other and may be used in left or right facing directions. For example, the side plate 10 faces to the right and the side plates 12, 14, 16 and 18 face to the left. Each side plate includes a flat vertical panel, such as the vertical panel 20 of the side plate 18 and an integral top flange, such as the top flange 22. The vertical panel of each of the side plates has an irregular but symmetrical peripheral edge 23. The peripheral edge is symmetrical about a vertical axis represented by the vertical center line 24. The symmetry also extends to the top flanges and allows each side plate to be left or right facing.

The irregular peripheral edge includes a generally horizontal bottom edge 30, and opposed arm edges 32, 34 for forming slots 36, 38 with vertical edges 40, 42, respectively. The side plate narrows in its upper portion as it transitions to the top flange 22. The top flange includes a horizontal panel 44 connected to a step down panel 46. Two sets of peripheral openings 50, 52 and 54, 56 are provided along the vertical edges 40, 42, respectively, while three large horizontally disposed openings 60, 62 and 64 are provided at the top of the vertical panel. Fastener openings 70, 72 and 74 are provided in the top flange.

The side plates may be made of aluminum plate having a thickness of about 0.125 inches and may easily be formed by a stamping operation to create the peripheral edge, the holes and the bends. The side plates may also be made of steel having a thickness of about 0.06 to 0.09 inches if more strength is required.

Figure 2:
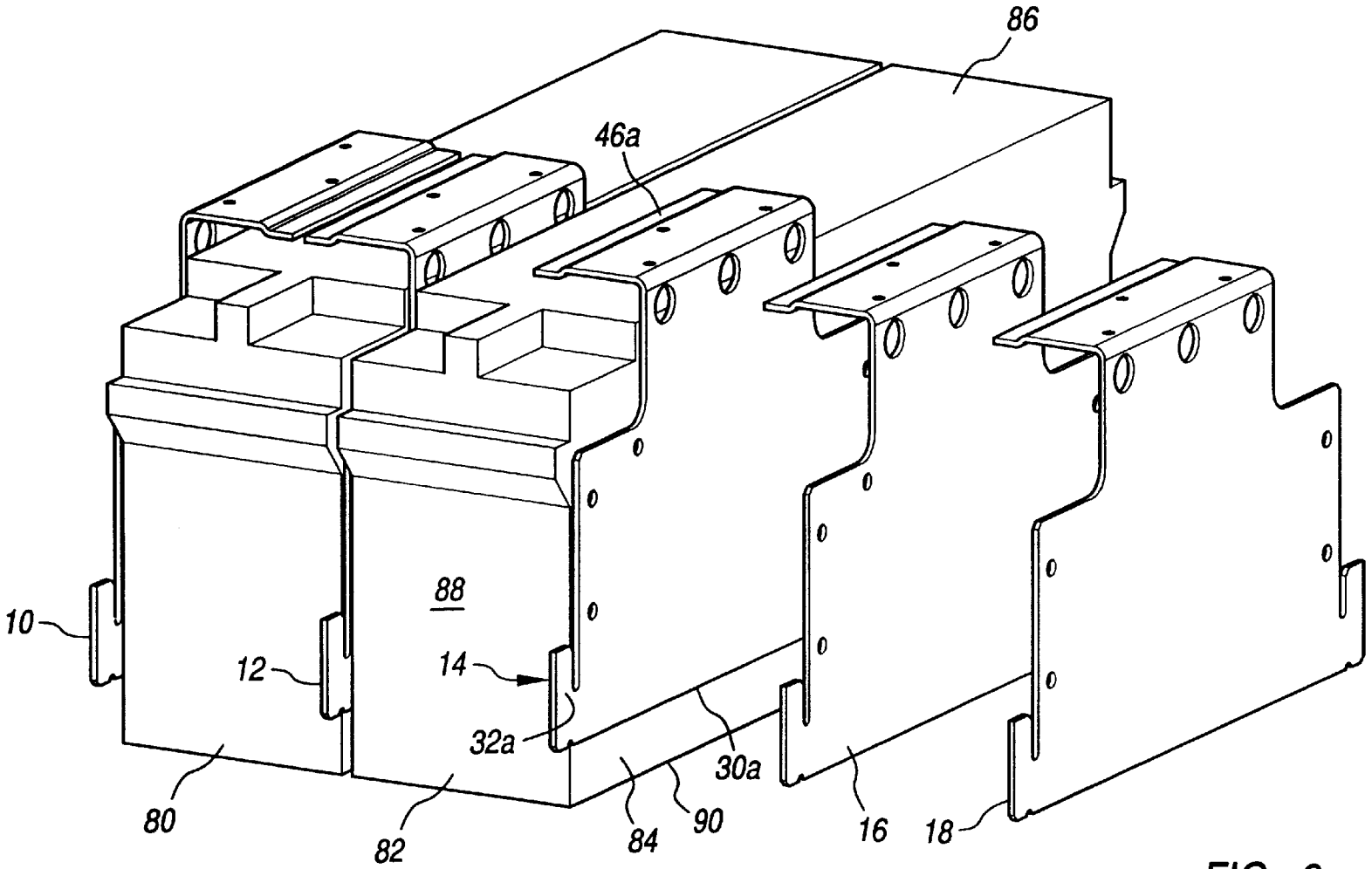
FIG. 2 is an isometric view of the five side plates of FIG. 1 and two batteries placed between three of the side plates.

Referring now to FIG. 2, the five side plates are again shown and in addition two batteries 80, 82 are illustrated in stalls created between the three side plates 10, 12 and 14. As depicted in the drawing, the side plates are modular in that any number of plates can be spaced in a horizontal direction to contain any number of batteries. In areas of high seismic events, referred to as Seismic Four Events, the relationship of plates to batteries is "n" side plates to "n−1" batteries. Depending upon expected seismic events, a different relationship may be used. It may also be seen that the vertical panels of the side plates abut the vertical sides of the batteries, such as the vertical side 84 of the battery 82. The step down panel 46*a* of the top flange of the side plate 14 is located close to but spaced from the top of the battery, such as the top 86 of the battery 82. Further, it may be observed that the arm 32*a* of the side plate 14 extends beyond the front surface 88 of the battery 82. Finally, it is noted that the bottom edge 30*a* of the side plate 14 is spaced from a bottom 90 of the battery 82. This spacing and the spacing between the top flange and the battery top mean that another device may easily be located under the batteries, such as a heating pad or plastic sheet as will be explained hereinbelow.

Figure 4:
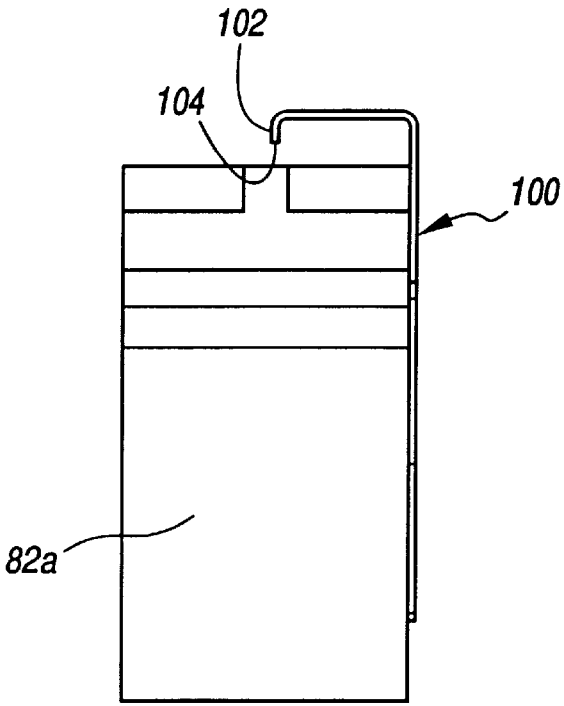
FIG. 4 is a front elevation view of the side plate of FIG. 3 and a restrained battery.
Figure 3:
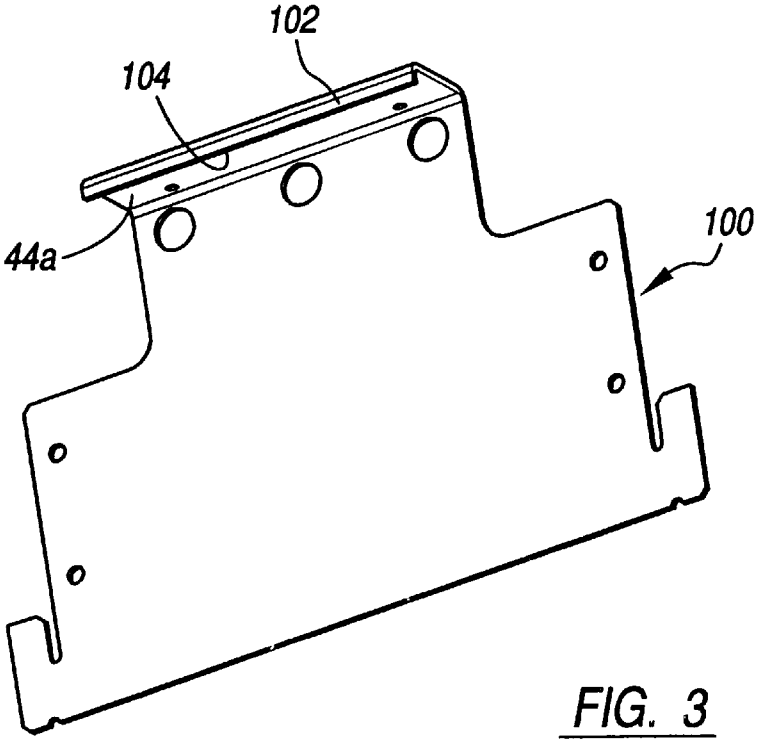
FIG. 3 is an upward looking isometric view of a variation side plate.

Referring now to FIGS. 3 and 4, there is shown a modified side plate 100. This side plate is very similar to the side plates of FIG. 1 except that instead of a step down panel 46, there is a depending flange 102. A lower edge 104 of the flange 102 is slightly spaced from a battery 82*a*. As with the side plates of FIG. 1, the side plate 100 prevents potentially damaging horizontal or lateral movement of the batteries when the side plates are connected as described below.

Figure 7:
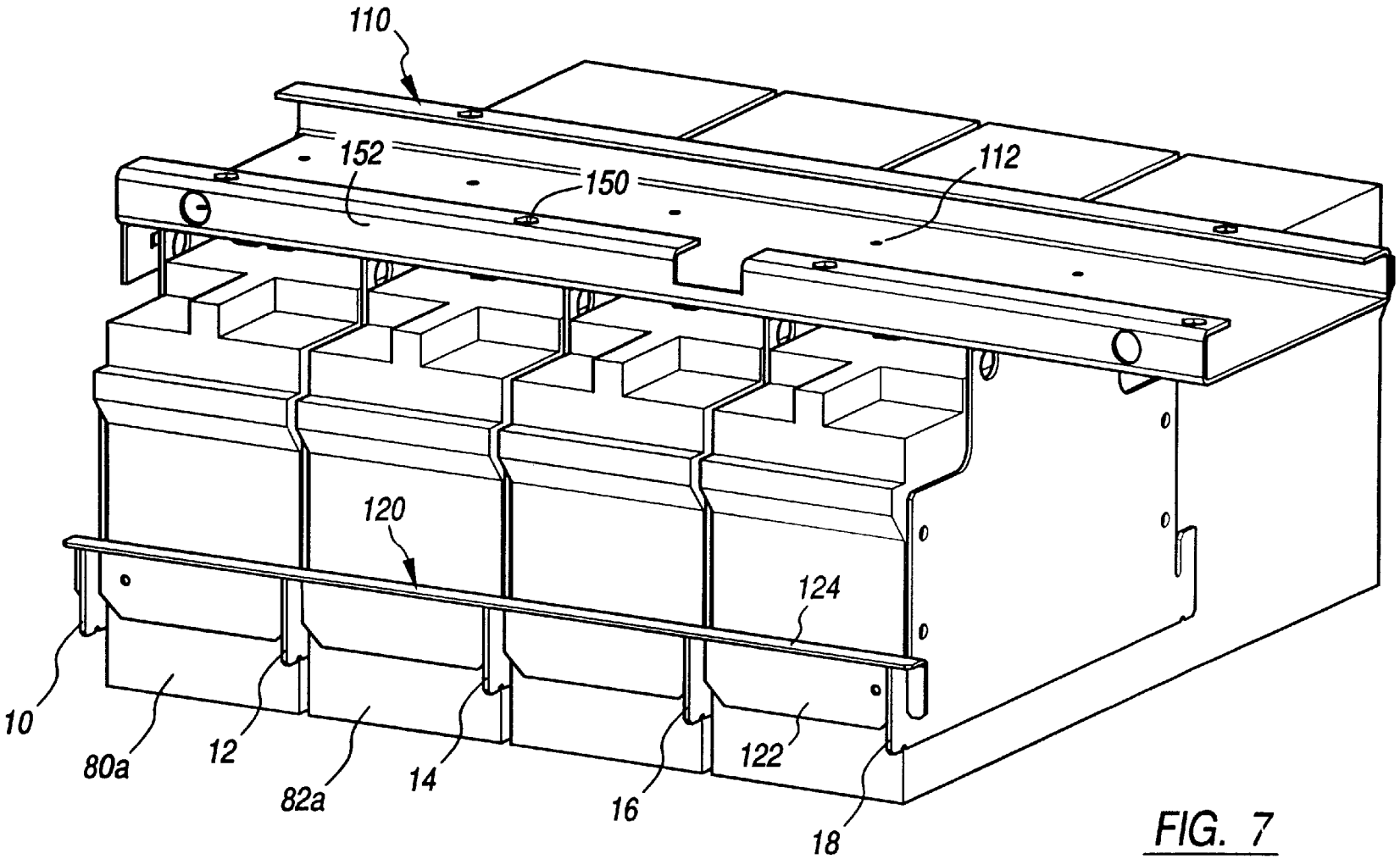
FIG. 7 is an isometric view of the five side plates, the front retaining bar and the channel connector of FIG. 5 and four constrained batteries.

Referring now to FIG. 5, there again is illustrated the five side plates 10, 12, 14, 16 and 18 where they are attached to an extended top frame member 110 having a generally channel shaped cross section. As shown in FIG. 7, the channel frame member 110 includes openings, such as the opening 112, which align with the openings in the top flanges so that a fastener, such as a screw or rivet (not shown), may attach the side plates to the channel frame member.

Figure 6:
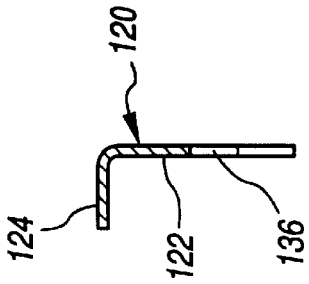
FIG. 6 is an elevation view taken along line 6—6 of FIG. 5.
Figure 5:
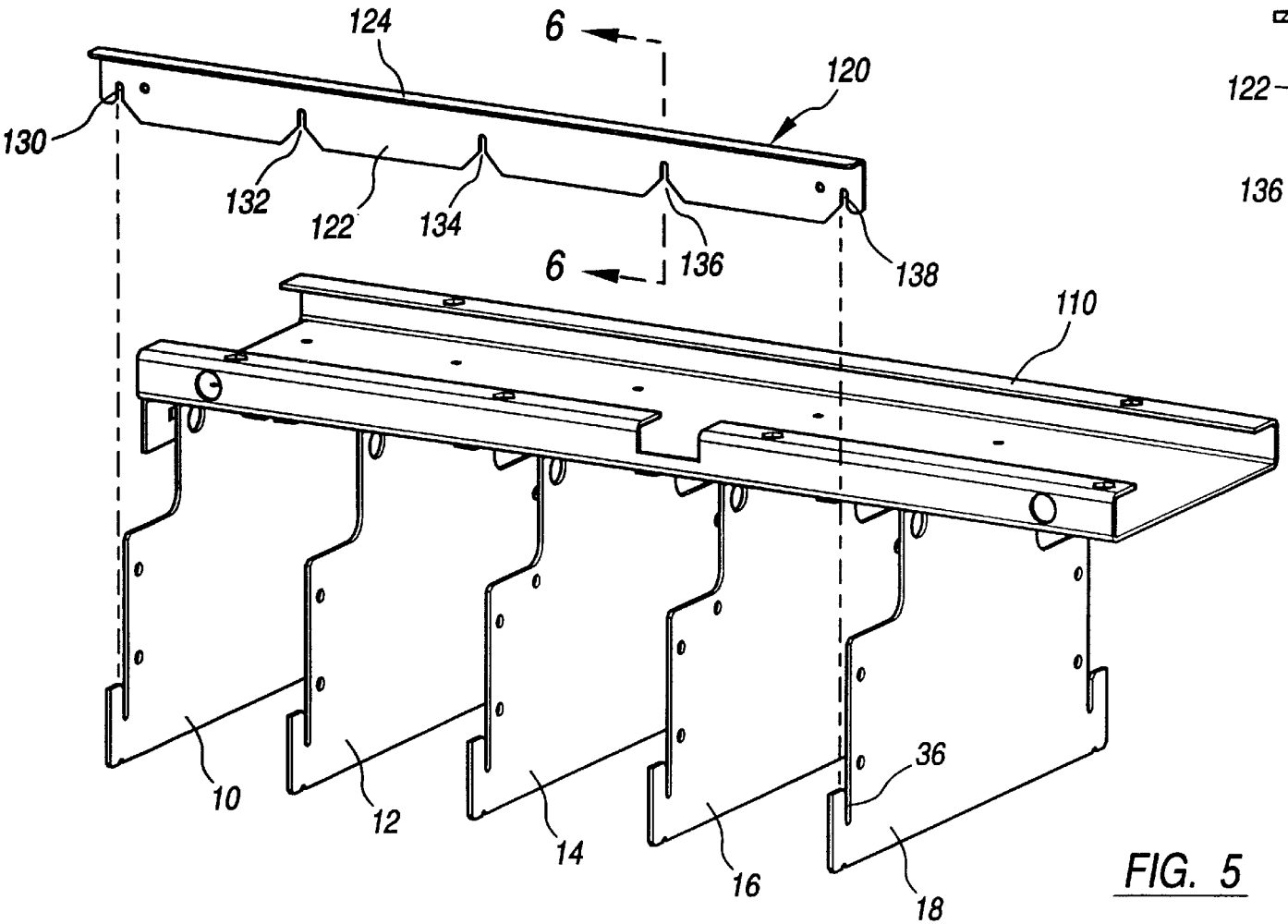
FIG. 5 is a partial exploded isometric view of the five side plates of FIG. 1, a front retainer bar and a channel connector.
Figure 8:
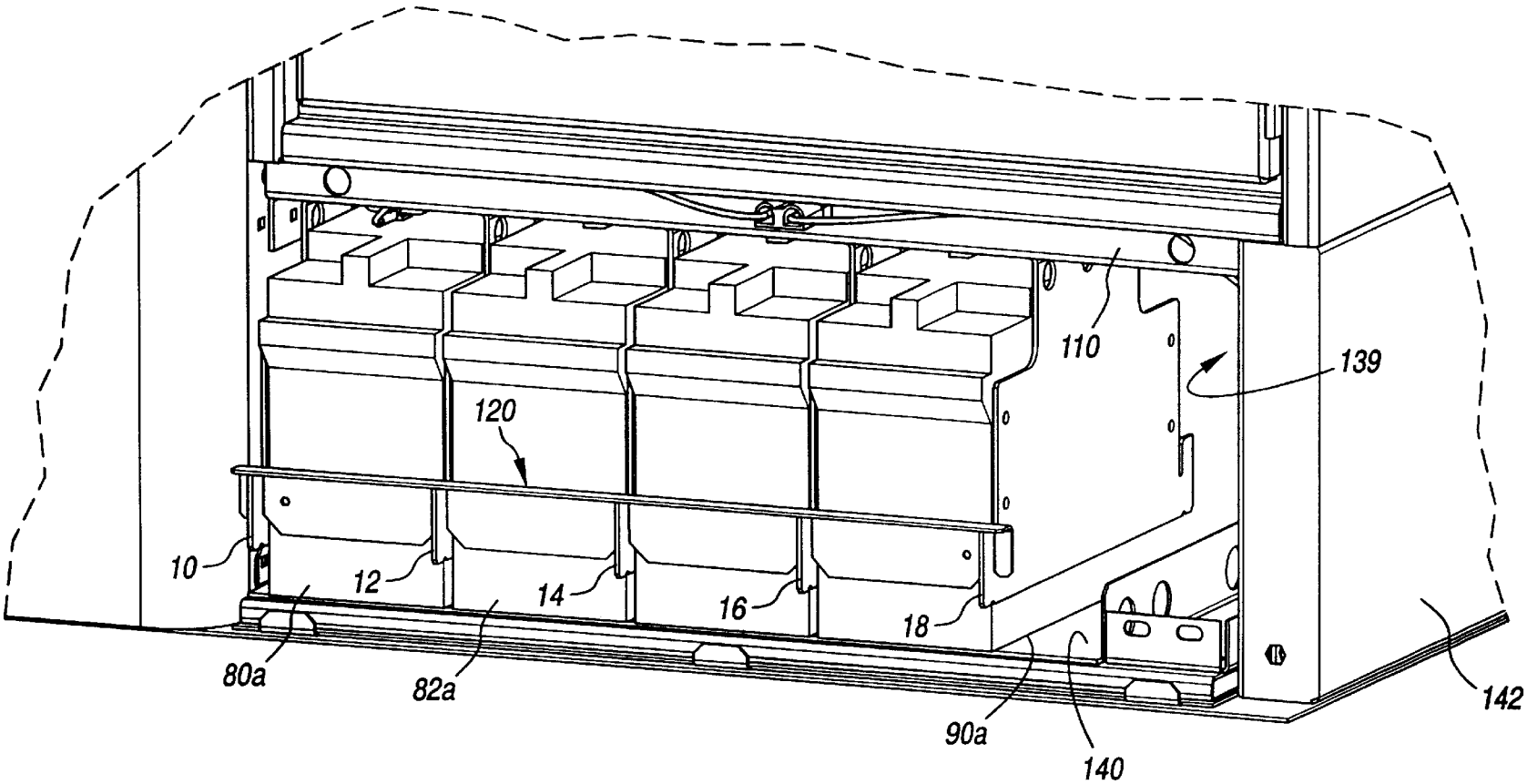
FIG. 8 is an isometric view of the five side plates, the retainer bar, the channel connector and four constrained batteries of FIG. 7 installed in a lower chamber of an equipment enclosure.

There is also shown a front retainer bar 120, FIG. 5, which has an L-shaped section, FIG. 6, including a vertical portion 122 and a horizontal portion 124. Five slots 130, 132, 134, 136 and 138 are formed in the vertical portion 122 of the retainer bar. Each of these slots mate with a corresponding slot in the side plates, such as the bar slot 138 mating with the slot 36 in the side plates 18. A view of the retainer bar engaging the slots of the side plates is shown in FIGS. 7 and 8. When the retainer bar is in place, the batteries are restrained from forward movement. Thus, when the batteries are installed in a battery compartment or chamber 139 of an enclosure, such as shown in FIG. 8, each of the four batteries shown are restrained from lateral movement by the side plates, from forward movement by the retainer bar and from damaging upward movement by virtue of the side plates/top flanges and the connected channel frame member. This arrangement protects the batteries from movement due to seismic events without blocking the space under the batteries. A heating pad 140 or a plastic sheet is usually placed on the bottom surface of the equipment enclosure 142. The pad acts to keep the batteries at a predetermined optimum storage temperature regardless of ambient temperatures, and the pad and the sheet provide low friction surfaces to facilitate moving the batteries into or out of the enclosure. Thus, the bottom 90*a* of the battery slides on the pad or sheet and not on the metal of the enclosure.

Referring now to FIGS. 7 and 8, the integral side plates/top flanges, the retention bar and the channel frame member package the batteries. More batteries (or less) may also be packaged simply by adding or subtracting side plates, and by lengthening or shortening the retention bar and the channel frame member. Of course, as shown, a larger channel frame member can be used with a smaller number of batteries. The same is true for the retention bar. For example, a five battery retention bar with six slots may function with only four batteries and five side plates or with four batteries and two side plates.

The top extended channel frame member includes a second set of openings, such as the opening 150 located along an outer arm 152, which may be used to connect the channel frame 110 to a frame member (not shown) of the enclosure 142.

In operation, a determination is made of the number of batteries to be restrained. A plurality of side plates equal to the number of batteries plus one (or less if the area is more stable) are selected and attached to a channel frame member of appropriate length or greater length. Attachment is occasioned by fasteners received by the aligned openings in the channel frame member and the top flanges. The channel frame member is attached to the equipment enclosure in any suitable manner well known to those familiar with equipment enclosures. After the heating pad or low friction plastic sheet is installed, the batteries are then inserted into the stalls created between the side plates. After the batteries are in place, the retention bar, of at least a length to extend across all of the batteries, is lowered into the front slots of the side plates.

With the retention bar in place, the batteries are restrained from movement sideways by the side plates, or very far upwardly by the step flanges/top flanges or forwardly by the retention bar. Downward and backward movements are prevented by the floor and the wall or frame of the enclosure, respectively. Therefore, in the case of a seismic event, the batteries are prevented from damage or dislodgement.

An advantage of the inventive apparatus is that access to the region beneath the batteries and above the enclosure bottom panel is allowed so that the heating pad or even a hot or cold plate may be used, if necessary or desirable to maintain the batteries at a specific temperature or within a specific temperature range.

The specification describes in detail two embodiments of the present invention. Other modifications and variations will, under the doctrine of equivalents, come within the scope of the appended claims. For example, other geometries for the side plates, the retention bar and the channel frame may be developed and used but are considered equivalent structures. Also, less side plates may be used if the level of protection needed is lower. For example, for more stable areas, side plates may be used for every four batteries. The thickness and material used is also dependant on the stability of the area in which the system is to be used. Stronger side plates should be used in less stable areas. Still other alternatives will also be equivalent as will many new technologies. There is no desire or intention here to limit in any way the application of the doctrine of equivalents.

What is claimed is:

1. A containment system for a battery compartment of an equipment enclosure containing a plurality of batteries comprising:

a plurality of side plates, each side plate placed alongside a corresponding one of said plurality of batteries;

a plurality of top flanges, each top flange being connected to a corresponding side plate;

a front retainer bar for engaging each of said plurality of side plates adapted to prevent forward movement of batteries located along side said plurality of plates; and an extended frame member connected to each of said plurality of side plates for connecting each of said side plates to the enclosure.

2. The system as claimed in claim 1 wherein:

each of said plurality of said top flanges is integral with a corresponding one of said plurality of side plates; and each of said plurality of said top flanges includes a surface for engaging the top of a battery.

3. The system as claimed in claim 2 wherein:

each of said plurality of side plates includes a slot for receiving said front retainer bar; and said front retainer bar includes a plurality of slots.

4. The system as claimed in claim 3 wherein:

each of said plurality of side plates has an irregular peripheral edge, a length and a height; and each of said plurality of side plates is symmetrical about a vertical axis parallel to the height of said side plate and located at the mid-point of the length of said side plate.

5. The system as claimed in claim 4 wherein:

said extended frame member connected to each of said plurality of side plates has a channel shaped cross-section.

6. The system as claimed in claim 1 wherein:

each of said plurality of side plates includes a slot for receiving said front retainer bar.

7. The system as claimed in claim 1 wherein:

said front retainer bar includes a plurality of slots, each slot for receiving a corresponding one of said plurality of side plates.

8. The system as claimed in claim 1 wherein:

each of said plurality of side plates has an irregular peripheral edge, a length and a height; and each of said plurality of side plates is symmetrical about a vertical axis parallel to the height of said side plate and located at the mid-point of the length of said side plate.

9. The system as claimed in claim 1 including:

said extended frame member connected to each of said plurality of side plates has a channel shaped cross-section.

10. An equipment enclosure having a containment system for a battery compartment comprising:

an equipment enclosure having a battery compartment;

a plurality of side plates located within said battery compartment, each of said side plates being adapted to be placed along side a battery;

a plurality of top flanges, each of said top flanges being integral with a corresponding side plate and including openings for receiving fasteners;

a top frame member connected to each of said plurality of top flanges and having openings aligned with the openings of said plurality of top flanges, said top frame member being connected to said equipment enclosure and to said plurality of top flanges for affixing said plurality of side plates to enclosure; and a front retainer bar for engaging each of said plurality of side plates and adapted to prevent forward movement of batteries in said battery compartment.

11. The enclosure as claimed in claim 10 wherein:

each of said plurality of top flanges includes a surface for engaging the top of an adjacent battery.

12. The enclosure as claimed in claim 11 wherein:

each of said plurality of side plates includes a slot for receiving said front retainer bar; and said front retainer bar includes a plurality of slots, each slot adapted to receive one of said plurality of side plates.

13. The enclosure as claimed in claim 12 wherein:

said top frame member has a generally channel-shaped cross section.

14. The enclosure as claimed in claim 13 wherein:

said top frame member having additional fastener openings for connecting said top frame member to said enclosure.

* * * * *